US006236552B1

(12) United States Patent
Hattori

(10) Patent No.: US 6,236,552 B1
(45) **Date of Patent: *May 22, 2001**

(54) RELAY DRIVE CIRCUIT

(75) Inventor: Yasuhiro Hattori, Nagoya (JP)

(73) Assignees: Harness System Technologies Research, Ltd., Aichi; Sumitomo Wiring Systems, Ltd., Mie; Sumitomo Electric Industries, Ltd., Osaka, all of (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/962,062

(22) Filed: Oct. 31, 1997

(30) Foreign Application Priority Data

Nov. 5, 1996 (JP) ..... 8-292884
Nov. 5, 1996 (JP) ..... 8-292885
Nov. 5, 1996 (JP) ..... 8-292886

(51) Int. Cl.[7] ..... H01H 47/32
(52) U.S. Cl. ..... 361/160; 361/154
(58) Field of Search ..... 361/152–154, 361/160, 191; 307/25, 28, 29, 75

(56) References Cited

U.S. PATENT DOCUMENTS 3,634,733 * 1/1972 Boyer ..... 361/154
3,852,646 * 12/1974 Mason ..... 361/154
3,904,938 * 9/1975 Martin ..... 361/154
4,355,619 * 10/1982 Wilkinson ..... 361/154
4,729,056 * 3/1988 Edwards et al. ..... 361/154
4,797,779 * 1/1989 Richards et al. ..... 361/154
4,812,945 * 3/1989 D'Onofrio ..... 361/154
5,381,297 * 1/1995 Weber ..... 361/154
5,422,780 * 6/1995 Lignar ..... 361/154
5,469,825 * 11/1995 Golab et al. ..... 361/154
5,568,349 * 10/1996 Kowalewski ..... 361/154
5,793,599 * 8/1998 Schmitz ..... 361/154

FOREIGN PATENT DOCUMENTS 28 09 905 A1 9/1979 (DE) .
33 31 678 A1 4/1985 (DE) .
36 15 908 A1 11/1987 (DE) .
39 25 767 A1 4/1990 (DE) .

OTHER PUBLICATIONS

Patent Abstracts of Japan, Publication No. 05266772, Oct. 15, 1993.
Patent Abstracts of Japan, Publication No. 02270240, Nov. 05 1990.

* cited by examiner

*Primary Examiner*—Fritz Fleming
(74) *Attorney, Agent, or Firm*—Oliff & Berridge, PLC

(57) ABSTRACT

A relay driving circuit comprises, in addition to an in-car battery, a low-voltage power supply outputting a voltage lower than an output voltage of the in-car battery and higher than a relay actuating voltage. The output voltage of the low-voltage power supply is applied to a coil of a relay. Alternatively, the output voltage of the in-car battery may be applied to each relay coil for turning on the relay contacts, then the output voltage of the low-voltage power supply is applied to maintain the turning-on state of the relay.

2 Claims, 10 Drawing Sheets

RELAY DRIVE CIRCUIT

BACKGROUND OF THE INVENTION

This invention relates to a relay drive circuit for driving relays to turn on and off power supplied to loads from a power supply outputting a given voltage.

A conventional circuit for driving various loads 2 of an automobile uses relays. For example, as shown in FIG. 13, the circuit comprises a coil RC of a relay RL connected at one end to a voltage output terminal of an in-car battery 1 and grounded at the other end via an operation switch SW and one of relay contacts RS connected to the voltage output terminal of the in-car battery 1 and the other grounded via loads 2.

When the operation switch SW is turned on and a voltage equal to or more than an actuating voltage required for actuating the relay contacts RS is applied to the coil RC, the relay contacts RS are actuated and conducted. On the other hand, when the operation switch SW is turned off and the voltage applied to the coil RC becomes equal to or less than a release voltage, the relay contacts RS are released and restored to a non-conduction state.

In an automobile, circuit parts of relays, fuses, connectors, etc., are mounted on an electric junction box intensively. Since the circuit parts generate heat, it is necessary to design so as not to exceed the heat resistance temperatures of the parts and the electric junction box.

However, in recent years, as the number of relays has been increased with an increase in in-car electrical components and relays have been placed at a high density with miniaturization of the relays, the effect of heat generation of the relays, namely, coils becomes large and the heat generation needs to be suppressed.

Generally, the relay actuating voltage is about 7–8 V, the relay release voltage is about 2–3 V, and the power supply voltage of the in-car battery is 12 V. Thus, the relay generates unnecessary heat as much as the voltage difference between the battery power supply voltage and the relay actuating voltage.

Then, as shown in FIG. 14, a conventional circuit is known which comprises a resistor R connected to a coil RC of a relay RL in series for decreasing an applied voltage to the coil RC, thereby reducing the heating value of the relay RL.

A relay drive circuit is proposed in Japanese Patent Laid-Open No. Hei 8-55551 wherein a drive transistor for supplying an excitation current to a relay coil is operated in a region in which it is not completely turned on, thereby decreasing an applied voltage to the coil.

Although the conventional circuit shown in FIG. 14 decreases the heating value of the coil RC of the relay RL, the resistor R generates heat, thus it is difficult to sufficiently decrease the heating value of the whole circuit.

Also in the conventional relay drive circuit described in Japanese Patent Laid-Open No. Hei 8-5555, the reduction part of the coil application voltage is converted into heat by other circuit parts of transistors, etc., thus it is still difficult to sufficiently decrease the heating value of the whole circuit.

Furthermore, in the conventional relay drive circuit described in Japanese Patent Laid-Open No. Hei 8-55551, if the actuated relay contacts are restored to a release state for a reason such as vibration or impulse, the relay cannot again be placed in an actuation state unless an operation switch is once turned off, then on.

It is therefore an object of the invention to provide a relay drive circuit that can decrease the coil heating value efficiently and hold relays in an actuation state reliably.

According to the invention, there is provided a relay drive circuit for controlling an excitation current supplied to relay coils with relay contacts placed between a reference power supply outputting a given voltage higher than a relay actuating voltage and a plurality of loads, thereby actuating or releasing the relay contacts, the relay drive circuit comprising a low-voltage power supply outputting a voltage lower than the given voltage and higher than the relay actuating voltage for supplying the excitation current to each relay coil from the low-voltage power supply.

According to the above configuration, an excitation current is supplied to each relay coil from the low-voltage power supply outputting a voltage lower than the given voltage output from the reference power supply and higher than the relay actuating voltage, whereby the relay contacts can be reliably actuated and the heating value from the coils can be reduced as compared with supply of the excitation current from the reference power supply.

According to the invention, there is provided a relay drive circuit for controlling an excitation current supplied to relay coils with relay contacts placed between a reference power supply outputting a given voltage higher than a relay actuating voltage and a plurality of loads, thereby actuating or releasing the relay contacts, the relay drive circuit comprising a low-voltage power supply outputting a voltage lower than the given voltage and higher than a relay release voltage, time count means for counting the elapsed time since the actuation time of each relay, storage means for storing a preset time, and control means for supplying the excitation current from the reference power supply when each relay is actuated and supplying the excitation current from the reference power supply until the expiration of the preset time since the actuation time of each relay, then supplying the excitation current from the low-voltage power supply.

According to the configuration, when the relay contacts are actuated, the excitation current is supplied to the relay coil from the reference power supply outputting the given voltage, and the excitation current is supplied from the reference power supply until the expiration of the preset time since the actuation time of the relay contacts, then the excitation current is supplied from the low-voltage power supply outputting a voltage lower than the given voltage output from the reference power supply and higher than the relay release voltage, whereby the actuation state of the relay contacts is reliably maintained and the heating value from the coils is reduced as compared with continuous supply of the excitation current from the reference power supply.

The setup time is preset a little longer than the time taken until the relay contacts are actuated from the supply start time of the excitation current to the coil, whereby the relay contacts can be actuated reliably.

In the relay drive circuit as mentioned above, the low-voltage power supply outputs a voltage lower than the relay actuating voltage.

According to the configuration, the excitation current is supplied from the low-voltage power supply outputting a voltage lower than the relay actuating voltage, whereby the heating value from the coils is furthermore reduced.

According to the invention, there is provided a relay drive circuit for controlling an excitation current supplied to relay coils with relay contacts placed between a reference power supply outputting a given voltage higher than a relay actuating voltage and a plurality of loads, thereby actuating or releasing the relay contacts, the relay drive circuit comprising a low-voltage power supply outputting a voltage lower than the given voltage and higher than a relay release voltage, a reference voltage circuit for supplying an excitation current to each relay coil from the reference power supply, a low-voltage circuit for supplying an excitation current to each relay coil from the low-voltage power supply, and a stop control circuit for stopping the excitation current supply from the reference power supply after the expiration of a predetermined time since the actuation time of the relay contacts after supply of the excitation current from the reference power supply.

According to the configuration, after the expiration of the predetermined time since the actuation time of the relay contacts after supply of the excitation current to each coil from the reference power supply, the excitation current supply from the reference power supply is stopped, then the excitation current is supplied from the low-voltage power supply outputting a voltage lower than the given voltage output from the reference power supply and higher than the relay release voltage, whereby the actuation state of the relay contacts is reliably maintained and the heating value from the coils is reduced as compared with continuous supply of the excitation current from the reference power supply.

The predetermined time is preset a little longer than the time taken until the relay contacts are actuated from the supply start time of the excitation current to the coil, whereby the relay contacts can be actuated reliably.

In the relay drive circuit as mentioned above, the low-voltage power supply outputs a voltage lower than the relay actuating voltage.

According to the configuration, the excitation current is supplied from the low-voltage power supply outputting a voltage lower than the relay actuating voltage, whereby the heating value from the coils is furthermore reduced.

Further, in the relay drive circuit as mentioned above, the stop control circuit comprises a capacitor and is built in the reference voltage circuit for lowering the applied voltage according to a predetermined time constant after the excitation current supply by voltage application to the coil from the reference power supply.

According to the configuration, the stop control circuit comprises a capacitor and is built in the reference voltage circuit for lowering the applied voltage according to a predetermined time constant after the excitation current supply by voltage application to the coil from the reference power supply, whereby a voltage higher than the relay actuating voltage is applied to the coil as long as a predetermined time and the relay contacts are actuated reliably.

Furthermore, according to the invention, there is provided a relay drive circuit for controlling an excitation current supplied to relay coils with relay contacts placed between a reference power supply outputting a given voltage higher than a relay actuating voltage and a plurality of loads, thereby actuating or releasing the relay contacts, the relay drive circuit comprising a low-voltage power supply outputting a voltage lower than the given voltage and higher than a relay release voltage, a reference voltage circuit for periodically supplying an excitation current as long as a preset time to each relay coil from the reference power supply when a relay actuation instruction is given, and a low-voltage circuit for supplying an excitation current to each relay coil from the low-voltage power supply when a relay actuation instruction is given.

According to the configuration, when a relay actuation instruction is given, the excitation current is periodically supplied as long as the preset time to each relay coil from the reference power supply outputting the given voltage and the excitation current is supplied to each relay coil from the low-voltage power supply outputting a voltage higher than the relay release voltage, whereby when the excitation current is supplied from the reference power supply, the relay contacts can be actuated and while the excitation current is supplied from the low-voltage power supply, the relay contacts are held in the actuation state. Resultantly, the heating value from the coils is reduced as compared with continuous supply of the excitation current from the reference power supply. If the actuated relay contacts are released for a reason such as vibration or impulse, when another excitation current is supplied from the reference power supply, the relay contacts are restored to the actuation state.

The setup time is preset a little longer than the time taken until the relay contacts are actuated from the supply start time of the excitation current to the coil, whereby the relay contacts can be actuated reliably.

In the relay drive circuit as mentioned above, the reference voltage circuit comprises an oscillation circuit for outputting a pulse signal having a pulse width of the setup time on a given period and a voltage supply circuit for supplying the excitation current from the reference power supply only while the pulse signal is output when a relay actuation instruction is given.

According to the configuration, when a pulse signal of a pulse width equal to the setup time is output on a given period and a relay actuation instruction is given, the excitation current is supplied from the reference power supply only while the pulse signal is output, whereby the excitation current is supplied from the reference power supply to the coil as long as the setup time every given period.

In the relay drive circuit as mentioned above, the low-voltage power supply outputs a voltage lower than the relay actuating voltage.

According to the configuration, the excitation current is supplied from the low-voltage power supply outputting a voltage lower than the relay actuating voltage, whereby the heating value from the coils is furthermore reduced.

DETAILED DESCRIPTION OF THE PREFERRED EMBODIMENTS

First Embodiment

Figure 1:
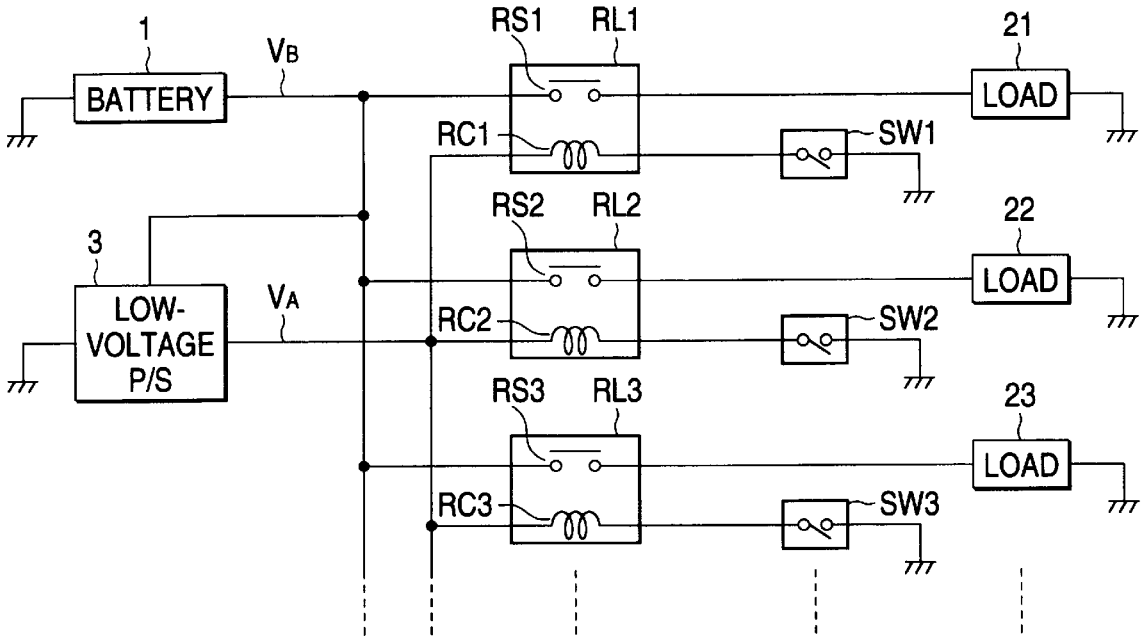
FIG. 1 is a circuit diagram to show a first embodiment of a vehicle load control circuit to which the invention is applied.

FIG. 1 is a circuit diagram to show a first embodiment of a vehicle load control circuit to which the invention is applied.

The vehicle load control circuit comprises an in-car battery (reference power supply) 1, loads 21, 22, 23, . . . of lamps, door lock solenoid, etc., relays RL1, RL2, RL3, switches SW1, SW2, SW3, . . . , and a low-voltage power supply 3 for controlling a power supply from the in-car battery 1 to the loads 21, 22, 23, . . . The relays RL1, RL2, RL3, . . . and the low-voltage power supply 3 are placed in an electric junction box (not shown) disposed in a proper place in the vehicle.

The relay RL1 is made up of relay contacts RS1 placed between the in-car battery 1 and the load 21 and a coil RC1 placed between the low-voltage power supply 3 and the switch SW1. Likewise, the relay RL2 (RL3) is made up of relay contacts RS2 (RS3) placed between the in-car battery 1 and the load 22 (23) and a coil RC2 (RC3) placed between the low-voltage power supply 3 and the switch SW2 (SW3).

Relay actuating voltage $V_S$, namely, coil application voltage at which the relay contacts are actuated is about 7–8 VDC. Relay release voltage $V_R$, namely, coil application voltage at which the relay contacts are released is about 2–3 VDC. Output voltage of the in-car battery 1, $V_B$ is a value higher than the relay actuating voltage $V_S$ (in the embodiment, 12 VDC).

The switches SW1, SW2, SW3, . . . are switches such as operation switches operated by the vehicle user and semiconductor switching elements turned on/off in response to the detection result of a sensor (not shown); one of switch contacts is connected to the coil RC1 (RC2, RC3) and the other is grounded.

The low-voltage power supply 3 is made of a switching power supply circuit made of a DC-DC converter using a switching transistor (not shown). It switches the output voltage $V_B$ of the in-car battery 1 applied to a primary winding by the switching transistor, rectifies and smooths a voltage induced on a secondary winding, and outputs voltage $V_A$. The output voltage $V_A$ is $V_B>V_A>V_S$ and is set to a valve close to the actuating voltage $V_S$ (in the embodiment, 10 V).

Figure 2:
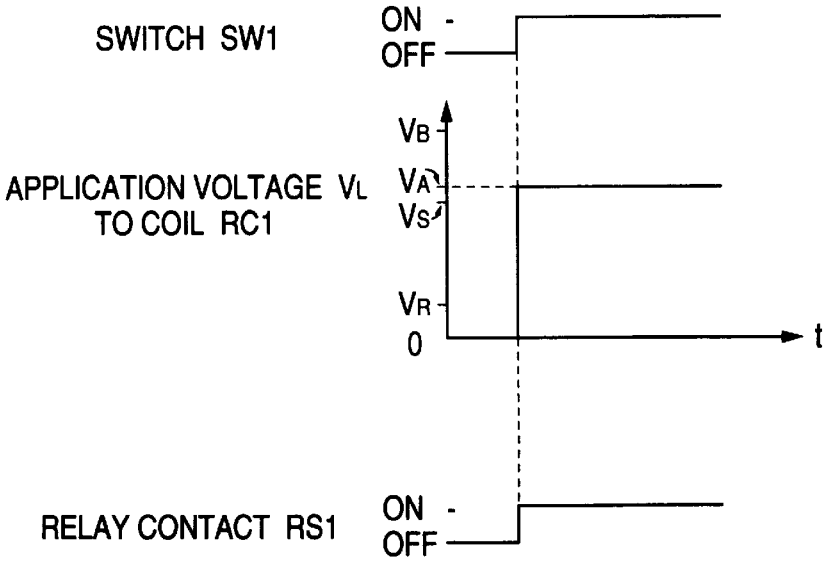
FIG. 2 is a timing chart to show the state of each part in the first embodiment of the invention.

The operation of the vehicle load control circuit will be discussed with FIG. 2, which is a timing chart to show the state of each part in the first embodiment.

When the switch SW1 is turned on, the output voltage $V_A$ of the low-voltage power supply 3 slightly higher than the actuating voltage $V_S$ is applied to the coil RC1 of the relay RL1, thus turning on the relay contacts RS. The relay RL2 (RL3) also operates in similar manner to that described here.

Thus, according to the first embodiment, the vehicle load control circuit comprises the low-voltage power supply 3 outputting the voltage $V_A$ lower than the output voltage $V_B$ of the in-car battery 1 and higher than the relay actuating voltage $V_S$ in addition to the in-car battery 1 and applies the output voltage $V_A$ of the low-voltage power supply 3 to the coil RC1, . . . of the relay RL1, . . . , so that it can reduce the heating value from the coil RC1, . . . as compared with application of the output voltage $V_B$ of the in-car battery 1.

The switching power supply circuit having a small heating value is used as the low-voltage power supply 3, whereby the heat generation of the whole circuit can be decreased.

The single low-voltage power supply 3 is used to drive a plurality of relays, whereby the heating value can be most decreased.

Second Embodiment

Figure 3:
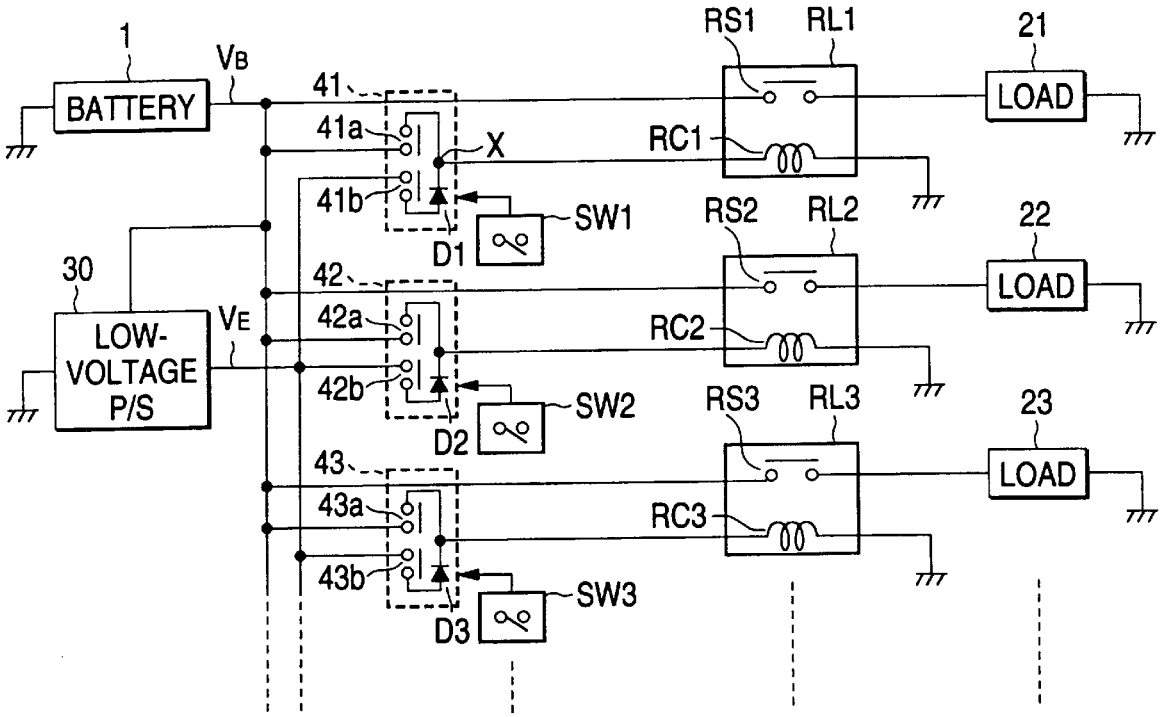
FIG. 3 is a circuit diagram to show a second embodiment of a vehicle load control circuit to which the invention is applied.

FIG. 3 is a circuit diagram to show a second embodiment of a vehicle load control circuit to which the invention is applied. Parts identical with or similar to those previously described with reference to FIG. 1 are denoted by the same reference numerals in FIG. 3.

As shown in FIG. 3, the second embodiment comprises a low-voltage power supply 30 in place of the low-voltage power supply 3 of the first embodiment and connection switch circuits 41, 42, 43, . . . A coil RC1 (RC2, RC3) of a relay RL1 (RL2, RL3) is connected at one end to the connection switch circuit 41 and is grounded at the other end.

The connection switch circuit 41 (42, 43) comprises a contact section 41*a* (42*a*, 43*a*) placed between one end of the coil RC1 (RC2, RC3) and an in-car battery 1, a contact section 41*b* (42*b*, 43*b*) placed between one end of the coil RC1 (RC2, RC3) and the low-voltage power supply 30, and a diode D1 (D2, D3) forward connected from the contact section 41b (42*b*, 43*b*) to connection point X between the contact section 41*b* (42*b*, 43*b*) and the connection point X.

Figure 4:
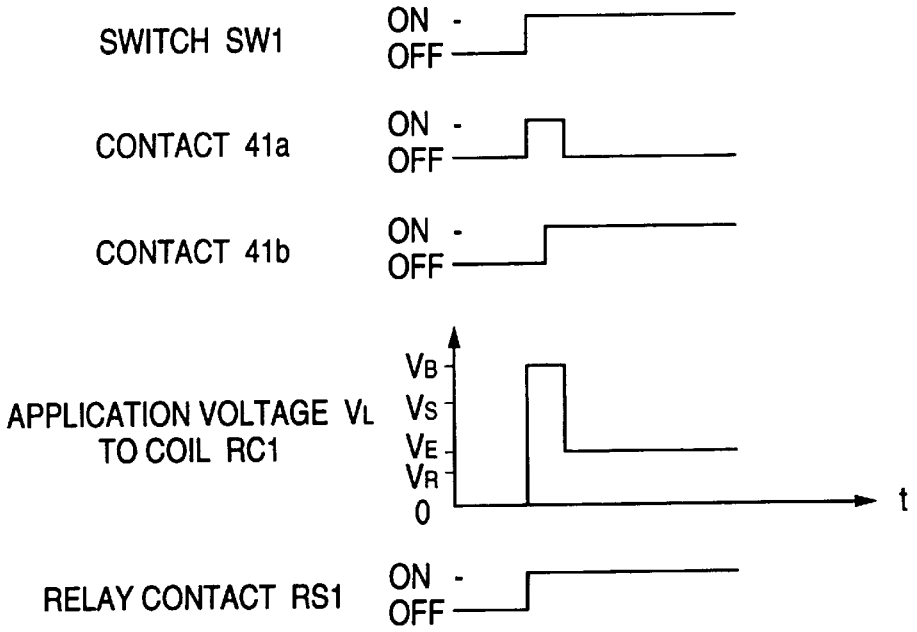
FIG. 4 is a timing chart to show the state of each part in the second embodiment of the invention.

For example, the contact sections 41*a* and 41*b* are made of semiconductor switching elements, etc., controlled by a control circuit (not shown) and are actuated at the timing as shown in FIG. 4 (described later).

The low-voltage power supply 30 is made of a switching power supply circuit made of a DC-DC converter using a switching transistor (not shown). It switches output voltage $V_B$ of the in-car battery 1 applied to a primary winding by the switching transistor, rectifies and smooths a voltage induced on a secondary winding, and outputs voltage $V_E$. The output voltage $V_E$ is ($V_B$>) $V_S>V_E>V_R$ and is set to a value close to release voltage $V_R$ (in the embodiment, 5 V).

Next, the operation of the vehicle load control circuit will be discussed with FIG. 4, which is a timing chart to show the state of each part in the second embodiment.

When the switch SW1 is turned on, first the contact section 41*a* is turned on and the output voltage $V_B$ of the in-car battery 1 higher than the actuating voltage $V_S$ is applied to the coil RC1 of the relay RL1, turning on relay contacts RS1. Next, the contact section 41*b* is turned on, then the contact section 41*a* is turned off and the output voltage $V_E$ of the low-voltage power supply 30 slightly higher than the release voltage $V_R$ is applied, thus the relay contacts RS1 remain on. The relay RL2 (RL3) also operates in similar manner to that described here.

Thus, according to the second embodiment, the vehicle load control circuit comprises the low-voltage power supply 30 outputting the voltage $V_E$ lower than the output voltage $V_B$ of the in-car battery 1 and slightly higher than the relay release voltage $V_R$ in addition to the in-car battery 1 and applies the output voltage $V_B$ of the in-car battery 1 to the coil RC1, . . . of the relay RL1, . . . for actuating the relay contacts, then applies the output voltage $V_E$ of the low-voltage power supply 30, so that it can reliably actuate the relay contacts and reduce the heating value from the coils as compared with continuation of application of the output voltage $V_B$ of the in-car battery 1.

The switching power supply circuit having a small heating value is used as the low-voltage power supply 30, whereby the heat generation of the whole circuit can be decreased.

The single low-voltage power supply 30 is used to drive a plurality of relays, whereby the heating value can be most decreased.

Third Embodiment

Figure 5:
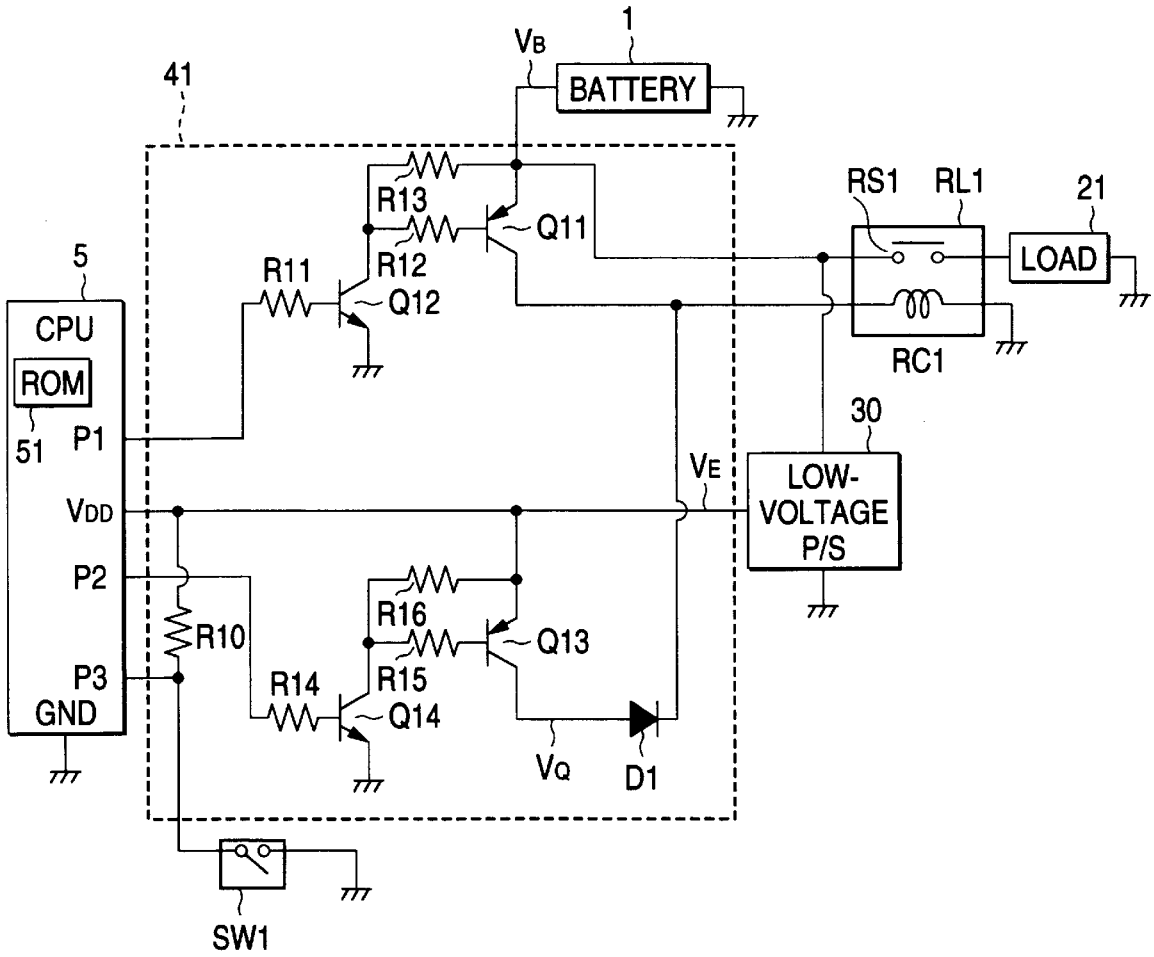
FIG. 5 is a circuit diagram to show a third embodiment of a vehicle load control circuit to which the invention is applied.

FIG. 5 is a circuit diagram to show a third embodiment of a vehicle load control circuit to which the invention is applied. Parts identical with or similar to those previously described with reference to FIG. 3 are denoted by the same reference numerals in FIG. 5.

The third embodiment provides a specific circuit configuration of the connection switch circuit 41 of the second embodiment, as shown in FIG. 5. The connection switch circuit 41 comprises a CPU 5, a diode D1, transistors Q11–Q14, and resistors R10–R16.

Loads 22, 23, . . . , relays RL2, RL3, . . . , switches SW2, SW3, . . . , and connection switch circuits 42, 43, . . . are not shown in FIG. 5.

The CPU 5 has output terminals P1 and P2, an input terminal P3, a power supply terminal $V_{DD}$ connected to a voltage output terminal of a low-voltage power supply 30, a ground terminal GND grounded, and a ROM 51 and controls the operation of the connection switch circuit 41 in response to an output signal from the output terminal P1, P2 as described later. The CPU 5 detects the level of a voltage signal input to the input terminal P3, thereby determining whether a switch SW1 is on or off. The ROM 51 stores preset time T.

First, the circuit configuration between the CPU 5 and an in-car battery 1 will be discussed. The output terminal P1 of the CPU 5 is connected to a base of the transistor Q12 via the resistor R11. An emitter of the transistor Q12 is grounded and a collector of the transistor Q12 is connected to a base and an emitter of the transistor Q11 via the resistors R12 and R13 respectively. The emitter of the transistor Q11 is connected to a voltage output terminal of the in-car battery 1. A collector of the transistor Q11 is connected to one end of a coil RC1 of a relay RL1.

Next, the circuit configuration between the CPU 5 and the low-voltage power supply 30 will be discussed. It is similar to the circuit configuration between the CPU 5 and the in-car battery 1. That is, the output terminal P2 of the CPU 5 is connected to a base of the transistor Q14 via the resistor R14. An emitter of the transistor Q14 is grounded and a collector of the transistor Q14 is connected to a base and an emitter of the transistor Q13 via the resistors R15 and R16 respectively. The emitter of the transistor Q13 is connected to the voltage output terminal of the low-voltage power supply 30. A collector of the transistor Q13 is connected to an anode of the diode D1 and a cathode of the diode D1 is connected to one end of the coil RC1 of the relay RL1.

Next, the miscellaneous circuit configuration will be discussed. One contact of the switch SW1 is connected to the input terminal P3 of the CPU 5 and the voltage output terminal of the low-voltage power supply 30 via the resistor R10 and the other contact of the switch SW1 is grounded, whereby when the switch SW1 is off, a high signal is input to the input terminal P3 and when the switch SW1 is turned on, a low signal is input to the input terminal P3, so that the CPU can determine whether the switch SWl is on or off.

Figure 6:
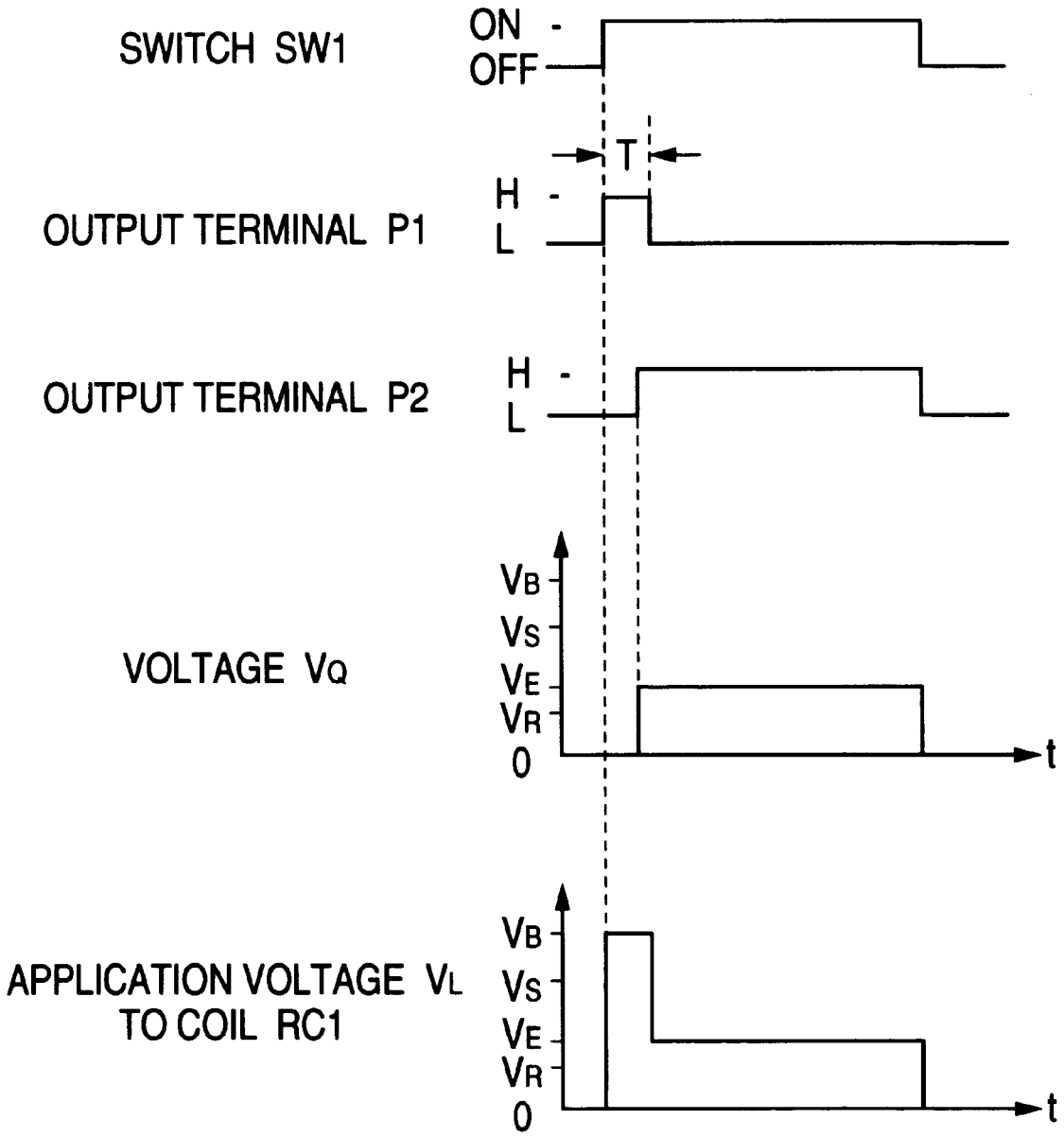
FIG. 6 is a timing chart to show the state of each part in the third embodiment of the invention.

Next, the operation of the vehicle load control circuit will be discussed with FIG. 6, which is a timing chart to show the state of each part in the third embodiment.

When the switch SW1 is turned on, first a high signal is output from the output terminal P1 of the CPU 5 and the transistor Q12 is turned on, thereby turning on the transistor Q11, applying output voltage $V_B$ of the in-car battery 1 higher than actuating voltage $V_S$. to the coil RC1 of the relay RL1, turning on relay contacts RS1.

At this time, the diode D1 blocks a current flowing into the transistor Q13 from the transistor Q11.

Next, a high signal is output from the output terminal P2 of the CPU 5 and the transistor Q14 is turned on, thereby turning on the transistor Q13. The CPU 5 counts the elapsed time since the high signal was output from the output terminal P1. After the expiration of the setup time T, the output signal from the output terminal P1 of the CPU 5 is restored to a low signal, whereby output voltage $V_E$ of the low-voltage power supply 30 slightly higher than release voltage $V_R$ is applied to the coil RC1 of the relay RL1, so that the relay contacts RS1 are held on.

If the setup time T is preset a little longer than the time required until the relay contacts RS1 are actuated from the start of application of the output voltage $V_B$ of the in-car battery 1, the relay contacts RS1 can be actuated reliably.

The connection switch circuit 42, 43 (not shown) may adopt a similar circuit configuration to that of the connection switch circuit 41 and can share the in-car battery 1, the low-voltage power supply 30, and the CPU 5.

Thus, according to the third embodiment, the vehicle load control circuit comprises the low-voltage power supply 30 outputting the voltage $V_E$ lower than the output voltage $V_B$ of the in-car battery 1 and slightly higher than the relay release voltage $V_R$ in addition to the in-car battery 1 and applies the output voltage $V_B$ of the in-car battery 1 to the coil RC1 of the relay RL1 for turning on the relay contacts, then applies the output voltage $V_E$ of the low-voltage power supply 30, so that it can reliably actuate the relay contacts and reduce the heating value from the coils as compared with continuation of application of the output voltage $V_B$ of the in-car battery 1, as in the second embodiment.

The switching power supply circuit having a small heating value is used as the low-voltage power supply 30, whereby the heat generation of the whole circuit can be decreased.

The low-voltage power supply 30 is shared as a power supply of 5-V circuit parts of the CPU 5, etc., whereby an increase in the number of parts can be suppressed and the heating value can be decreased.

The low-voltage power supply 30 may be disposed in a plurality of electric junction boxes in the vehicle for connection to a plurality of relays. It may also be disposed in one place in the vehicle for connection to all relays. In this case, the single low-voltage power supply 30 is used to drive all relays, whereby the heating value can be most decreased.

The low-voltage power supply 3, 30 may be made of a primary or secondary battery of the output voltage $V_A$, $V_E$. To use a secondary battery, the low-voltage power supply may be able to be charged by the in-car battery 1.

We have discussed the embodiments of applying the invention to the vehicle load control circuits, but the invention is not limited to them and may be applied to general relay drive circuits.

As we have discussed, according to the invention, the excitation current is supplied to each relay coil from the low-voltage power supply outputting a voltage lower than the given voltage higher than the relay actuating voltage output from the reference power supply and higher than the relay actuating voltage, so that the relay contacts can be reliably actuated and the heating value from the coils can be reduced as compared with supply of the excitation current from the reference power supply.

When the relay contacts are actuated, the excitation current is supplied to the relay coil from the reference power supply outputting the given voltage higher than the relay actuating voltage, and the excitation current is supplied from the reference power supply until the expiration of the preset time since the actuation time of the relay contacts, then the excitation current is supplied from the low-voltage power supply outputting a voltage lower than the given voltage output from the reference power supply and higher than the relay release voltage, so that the actuation state of the relay contacts can be reliably maintained and the heating value from the coils can be reduced as compared with continuous supply of the excitation current from the reference power supply.

The excitation current is supplied from the low-voltage power supply outputting a voltage lower than the relay actuating voltage, whereby the heating value from the coils can be furthermore reduced.

Fourth Embodiment

Figure 7:
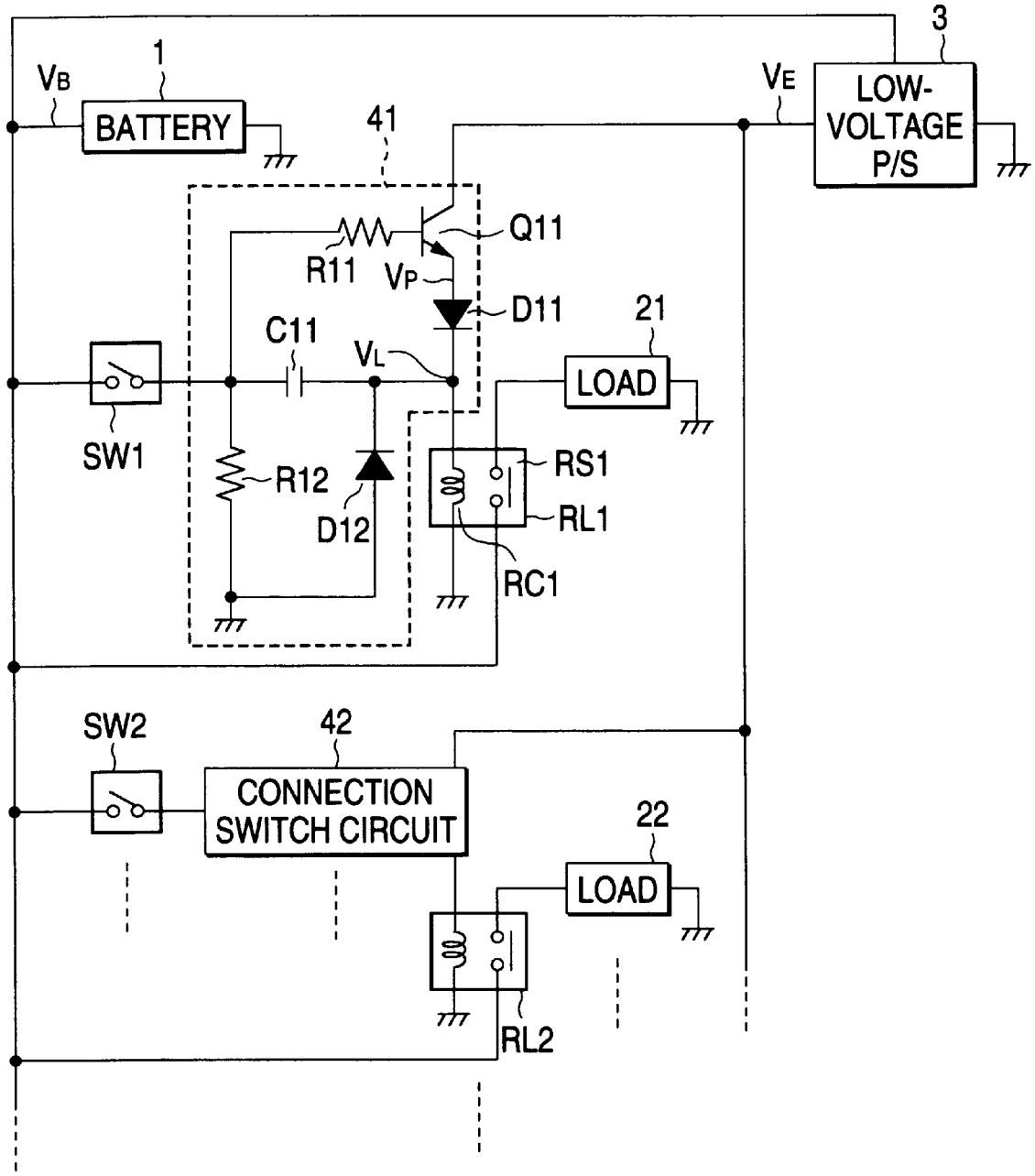
FIG. 7 is a circuit diagram to show a fourth embodiment of a vehicle load control circuit to which the invention is applied.

FIG. 7 is a circuit diagram to show a fourth embodiment of a vehicle load control circuit to which the invention is applied.

The vehicle load control circuit comprises an in-car battery (reference power supply) 1, loads 21, 22, . . . of lamps, door lock solenoid, etc., relays RL1, RL2, . . . , switches SW1, SW2, . . . , a low-voltage power supply 3, and connection switch circuits 41, 42, . . . for controlling a power supply from the in-car battery 1 to the loads 21, 22, . . .

The relays RL1, RL2, . . . , the low-voltage power supply 3, and the connection switch circuits 41, 42, . . . are placed in an electric junction box (not shown) disposed in a proper place in the vehicle.

The relay RL1 is made up of relay contacts RS1 placed between the in-car battery 1 and the load 21 and a coil RC1 placed between the connection switch circuit 41 and ground.

Relay actuating voltage $V_S$, namely, coil application voltage at which the relay contacts are actuated is about 7–8 VDC. Relay release voltage $V_R$, namely, coil application voltage at which the relay contacts are released is about 2–3 VDC. Output voltage of the in-car battery 1, $V_B$, is a value higher than the actuating voltage $V_S$ (in the embodiment, 12 VDC). The connection switch circuits 41, 42, . . . have a similar configuration.

The switches SW1, SW2, . . . are switches such as operation switches operated by the vehicle user and semiconductor switching elements turned on/off in response to the detection result of a sensor (not shown); one of switch contacts is connected to the connection switch circuit 41, 42 and the other is connected to a voltage output terminal of the in-car battery 1.

The low-voltage power supply 3 is made of a switching power supply circuit made of a DC-DC converter using a switching transistor (not shown). It switches the output voltage $V_B$ of the in-car battery 1 applied to a primary winding by the switching transistor, rectifies and smooths a voltage induced on a secondary winding, and outputs voltage $V_E$. The output voltage $V_E$ is $(V_B>)V_S$22 $V_E>V_R$ and is set to a value close to the release voltage $V_R$ (in the embodiment, 5 V).

The connection switch circuit 41 comprises a transistor Q11, diodes D11 and D12, resistors R11 and R12, and a capacitor C11 and functions as a reference voltage circuit, a low-voltage circuit, and a stop control circuit.

The transistor Q11 has a collector connected to a voltage output terminal of the low-voltage power supply 3, a base connected to one contact of the switch SW1 via the resistor R11, and an emitter connected to an anode of the diode D11.

A cathode of the diode 11 is connected to the coil RC1 of the relay RL1, one contact of the switch SW1 via the capacitor C11, and a cathode of the diode D12.

An anode of the diode D12 is grounded and one contact of the switch SW1 is grounded via the resistor R12. The diode D12 is provided to bypass a counter-electromotive force generated at the coil RC1 when the relay RL1 is turned off.

Figure 8:
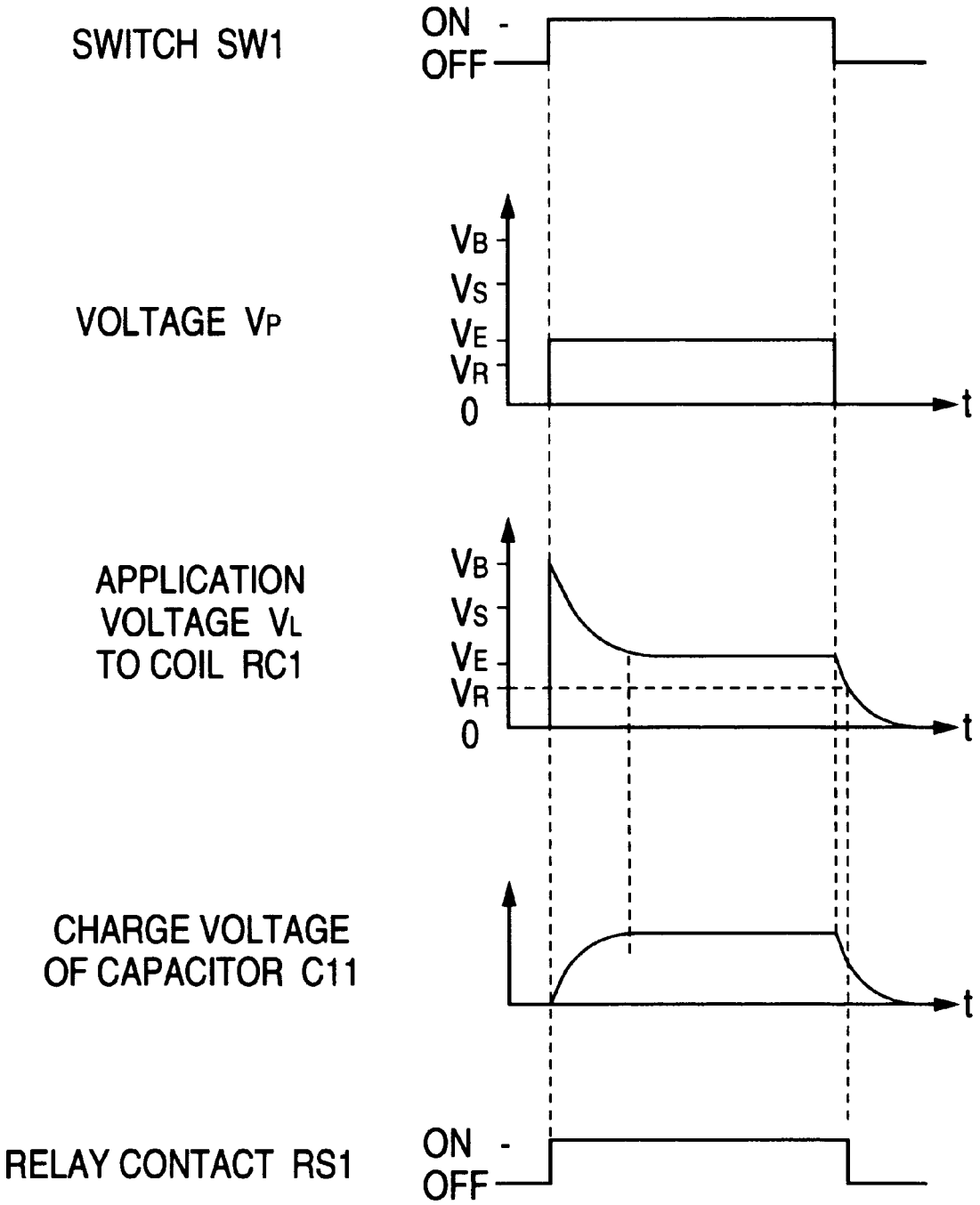
FIG. 8 is a timing chart to show the state of each part in the fourth embodiment of the invention.

Next, the operation of the vehicle load control circuit will be discussed with FIG. 8, which is a timing chart to show the state of each part in the fourth embodiment.

When the switch SW1 is turned on, first the output voltage $V_B$ of the in-car battery 1 is applied to the coil RC1 of the relay RL1, thus application voltage $V_L$ to the coil RC1 becomes higher than the actuating voltage $V_S$, turning on the relay contacts RS1.

At the same time, a base current is supplied through the resistor R11 and the transistor Q11 is turned on, whereby anode voltage $V_P$ of the diode D11 becomes equal to the output voltage $V_E$ of the low-voltage power supply 3.

At this time, the diode D11 blocks current flowing into the anode from the cathode of the diode D11.

Next, as the capacitor C11 is charged by the output voltage $V_B$ of the in-car battery 1, the application voltage $V_L$ to the coil RC1 lowers. However, when the voltage falls below the anode voltage $V_P$ of the diode D11, the output voltage $V_E$ of the low-voltage power supply 3 slightly higher than the release voltage $V_R$ is applied to the coil RC1 via the diode D11, so that the relay contacts RSI are held on.

When the switch SW1 is turned off, charges accumulated in the capacitor C11 are discharged through the resistor R12 and the charge voltage lowers, whereby the transistor Q11 is turned off and the application voltage $V_L$ to the coil RC1 falls below the release voltage $V_R$. At this time, the relay contacts RS1 are turned off.

Thus, according to the fourth embodiment, the vehicle load control circuit comprises the low-voltage power supply 3 outputting the voltage $V_E$ lower than the output voltage $V_B$ of the in-car battery 1 and slightly higher than the relay release voltage $V_R$ in addition to the in-car battery 1 and applies the output voltage $V_B$ of the in-car battery 1 to each relay coil for turning on the relay contacts, then applies the output voltage $V_E$ of the low-voltage power supply 3, so that it can reliably actuate the relay contacts and reduce the heating value from the coils as compared with continuation of application of the output voltage $V_B$ of the in-car battery 1.

The switching power supply circuit having a small heating value is used as the low-voltage power supply 3, whereby the heat generation of the whole circuit can be decreased.

The single low-voltage power supply 3 is used to drive a plurality of relays, whereby the heating value can be most decreased.

Fifth Embodiment

Figure 9:
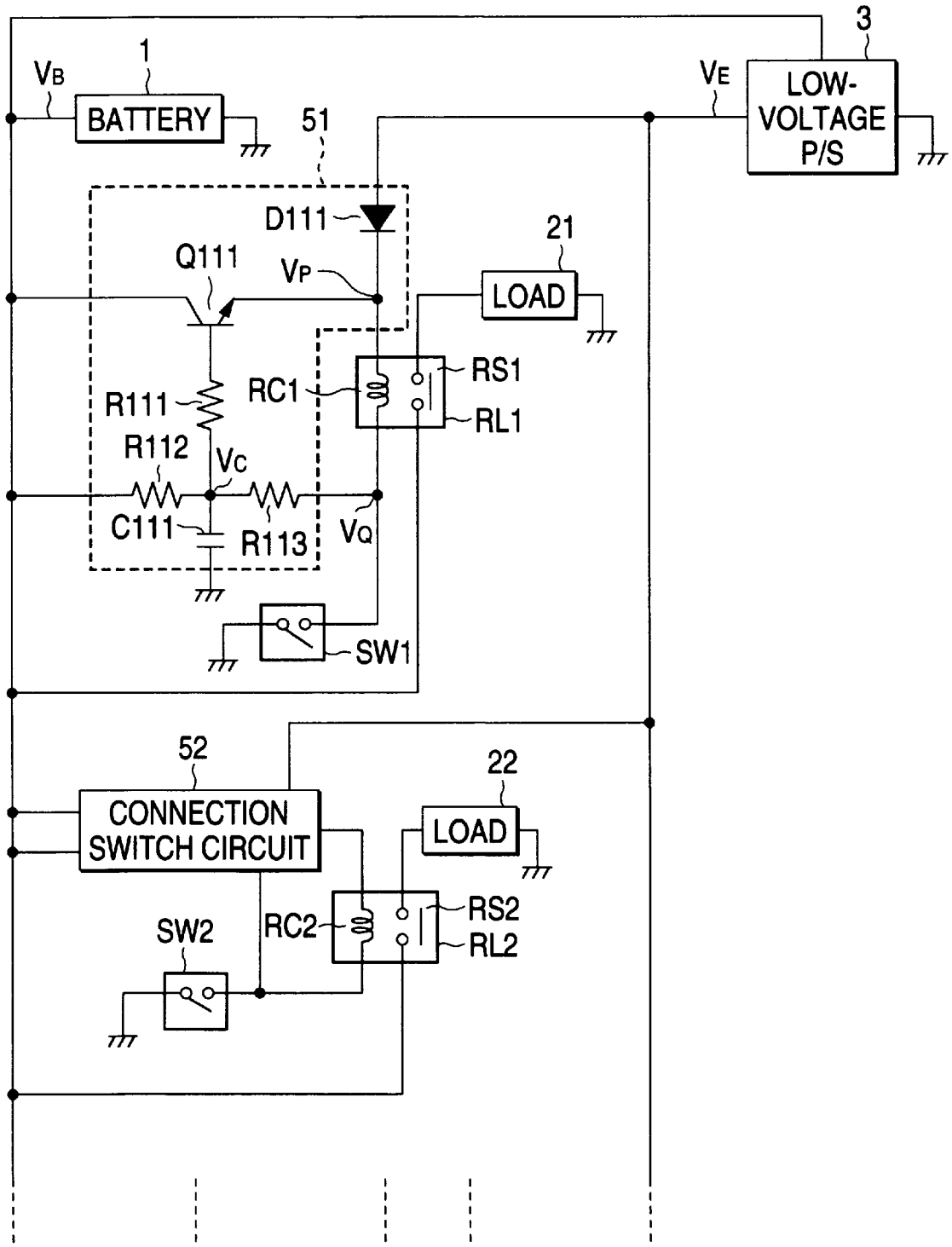
FIG. 9 is a circuit diagram to show a fifth embodiment of a vehicle load control circuit to which the invention is applied.

FIG. 9 is a circuit diagram to show a fifth embodiment of a vehicle load control circuit to which the invention is applied. Parts identical with or similar to those previously described with reference to FIG. 6 are denoted by the same reference numerals in FIG. 9.

As shown in FIG. 9, the fifth embodiment comprises connection switch circuits 51, 52, . . . in place of the connection switch circuits 41, 42, . . . of the fourth embodiment. The connection switch circuits 51, 52 have a similar configuration.

The connection switch circuit 51 comprises a transistor Q111, a diode D111, resistors R111–R113, and a capacitor C111 and functions as a reference voltage circuit, a low-voltage circuit, and a stop control circuit.

The transistor Q111 has a collector connected to a voltage output terminal of an in-car battery 1, a base connected to the voltage output terminal of the in-car battery 1 via the resistors R111 and R112, and an emitter connected to a cathode of the diode D111 and one end of a coil RC1 of a relay RL1. An anode of the diode D111 is connected to a voltage output terminal of a low-voltage power supply 3.

The connection point of the resistors R111 and R112 is connected via the resistor R113 to the other end of the coil RC1 of the relay RL1 and one contact of a switch SW1 and is grounded via the capacitor C111. The other contact of the switch SW1 is grounded.

Figure 10:
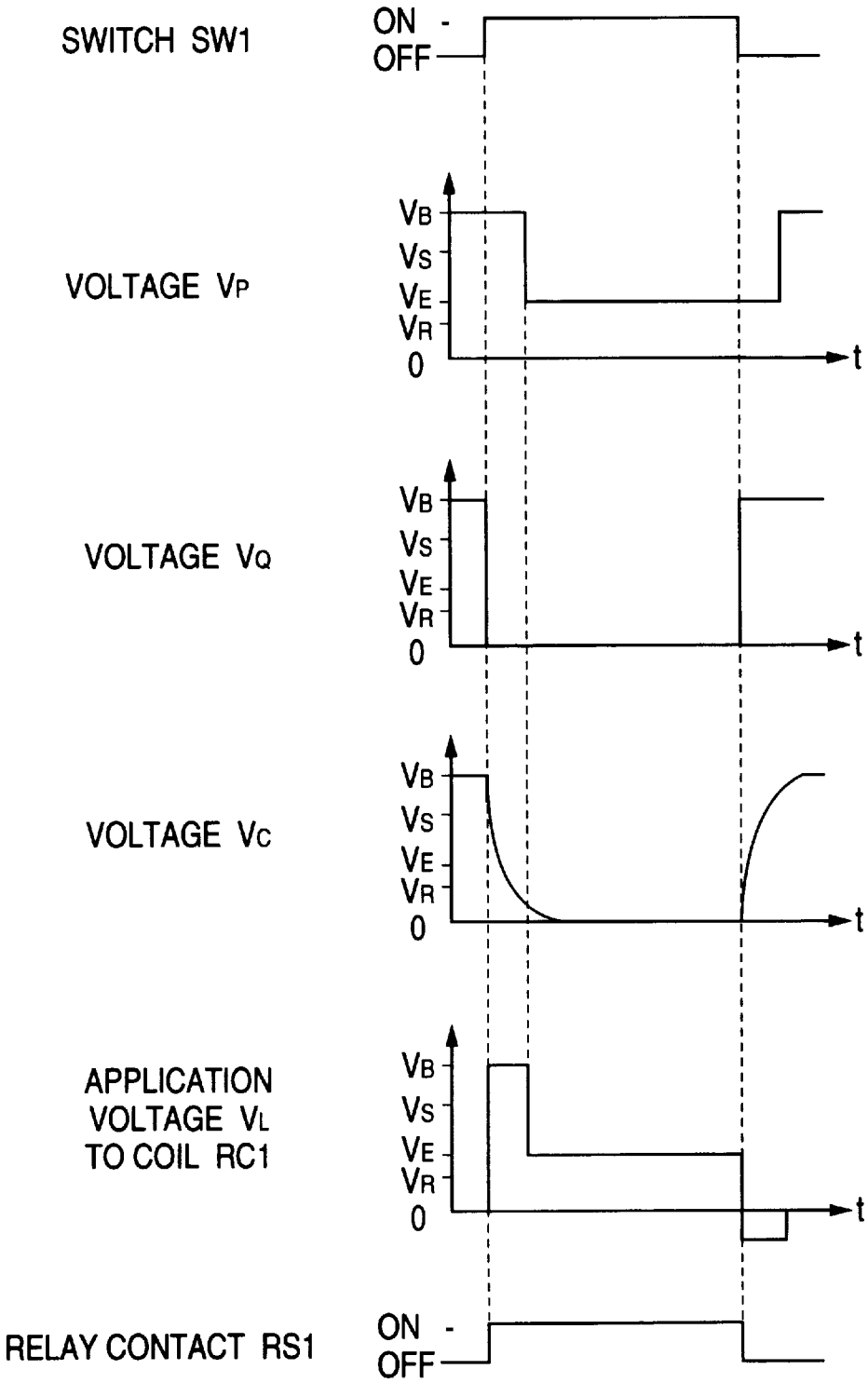
FIG. 10 is a timing chart to show the state of each part in the fifth embodiment of the invention.

Next, the operation of the vehicle load control circuit will be discussed with FIG. 10, which is a timing chart to show the state of each part in the fifth embodiment.

When the switch SW1 is off, a base current is supplied via the resistors R112 and R111 to the transistor Q111, which is on, and the capacitor C111 is charged.

Therefore, voltage at one end of the coil RC1, namely, emitter voltage $V_P$ of the transistor Q111, voltage $V_Q$ at the other end of the coil RC1, and charge voltage $V_C$ of the capacitor C111 are all equal to output voltage $V_B$ of the in-car battery 1. Thus, application voltage $V_L$ to the coil RC1 of the relay RL1 is 0.

At this time, the diode D111 blocks current flowing into the anode from the cathode of the diode 111.

When the switch SW1 is turned on, first the coil RC1 is grounded at the other end, thus the voltage $V_Q$ lowers to 0. On the other hand, charges of the capacitor C111 are discharged through the resistor R113 and the switch SW1. However, while the charge voltage $V_C$ lowers to a predetermined level, the transistor Q111 continues on.

Therefore, while the transistor Q111 is on, the application voltage $V_L$ to the coil RC1 of the relay RL1 becomes equal to the output voltage $V_B$ of the in-car battery 1 higher than actuating voltage $V_S$, whereby relay contacts RS1 are turned on.

Next, when the charge voltage $V_C$ lowers to the predetermined level and the transistor Q111 is turned off, the application voltage $V_L$ to the coil RC1 of the relay RL1 becomes equal to output voltage $V_E$ of the low-voltage power supply 3, thus the relay contacts RS1 are held on.

When the switch SW1 is turned off, the voltages $V_P$, $V_Q$, and $V_C$ are restored to the former level, namely, the output voltage $V_B$ of the in-car battery 1, thus the relay contacts RS1 are turned off. At this time, voltage is temporarily reversely applied, as shown in FIG. 4, by a counter-electromotive force generated at the coil RC1.

The capacity value of the capacitor C111 and the resistance value of the resistor R113 may be set so that the transistor Q111 continues on only until the relay contacts RS1 are actuated reliably.

Thus, according to the fifth embodiment, the vehicle load control circuit comprises the low-voltage power supply 3 outputting the voltage $V_E$ lower than the output voltage $V_B$ of the in-car battery 1 and slightly higher than the relay release voltage $V_R$ in addition to the in-car battery 1 and applies the output voltage $V_B$ Of the in-car battery 1 to the relay coil for turning on the relay contacts, then applies the output voltage $V_E$ of the low-voltage power supply 3, so that the effects similar to those of the fourth embodiment can be produced.

The low-voltage power supply 3 may be disposed in a plurality of electric junction boxes in the vehicle for connection to a plurality of relays. It may also be disposed in one place in the vehicle for connection to all relays. In this case, the single low-voltage power supply 3 is used to drive all relays, whereby the heating value can be most decreased.

The low-voltage power supply 3 may be shared as a power supply of 5-V circuit parts of an electronic controller, etc., whereby an increase in the number of parts can be suppressed and the heating value can be decreased.

The low-voltage power supply 3 may be made of a primary or secondary battery of the output voltage $V_E$. To use a secondary battery, the low-voltage power supply may be able to be charged by the in-car battery 1.

We have discussed the embodiments of applying the invention to the vehicle load control circuits, but the invention is not limited to them and may be applied to general relay drive circuits.

As we have discussed, according to the invention, after the expiration of the predetermined time since the actuation time of the relay contacts after supply of the excitation current to each coil from the reference power supply outputting a given voltage higher than the actuating voltage, the excitation current supply from the reference power supply is stopped, then the excitation current is supplied from the low-voltage power supply outputting a voltage lower than the given voltage output from the reference power supply and higher than the relay release voltage. Thus, the actuation state of the relay contacts can be reliably maintained and the heating value from the coils can be reduced as compared with continuous supply of the excitation current from the reference power supply.

The excitation current is supplied from the low-voltage power supply outputting a voltage lower than the relay actuating voltage, whereby the heating value from the coils can be furthermore reduced.

The stop control circuit comprises a capacitor and is built in the reference voltage circuit for lowering the applied voltage according to a predetermined time constant after the excitation current supply by voltage application to the coil from the reference power supply, whereby a voltage higher than the relay actuating voltage is applied to the coil as long as a predetermined time and the relay contacts can be actuated reliably.

Sixth Embodiment

Figure 11:
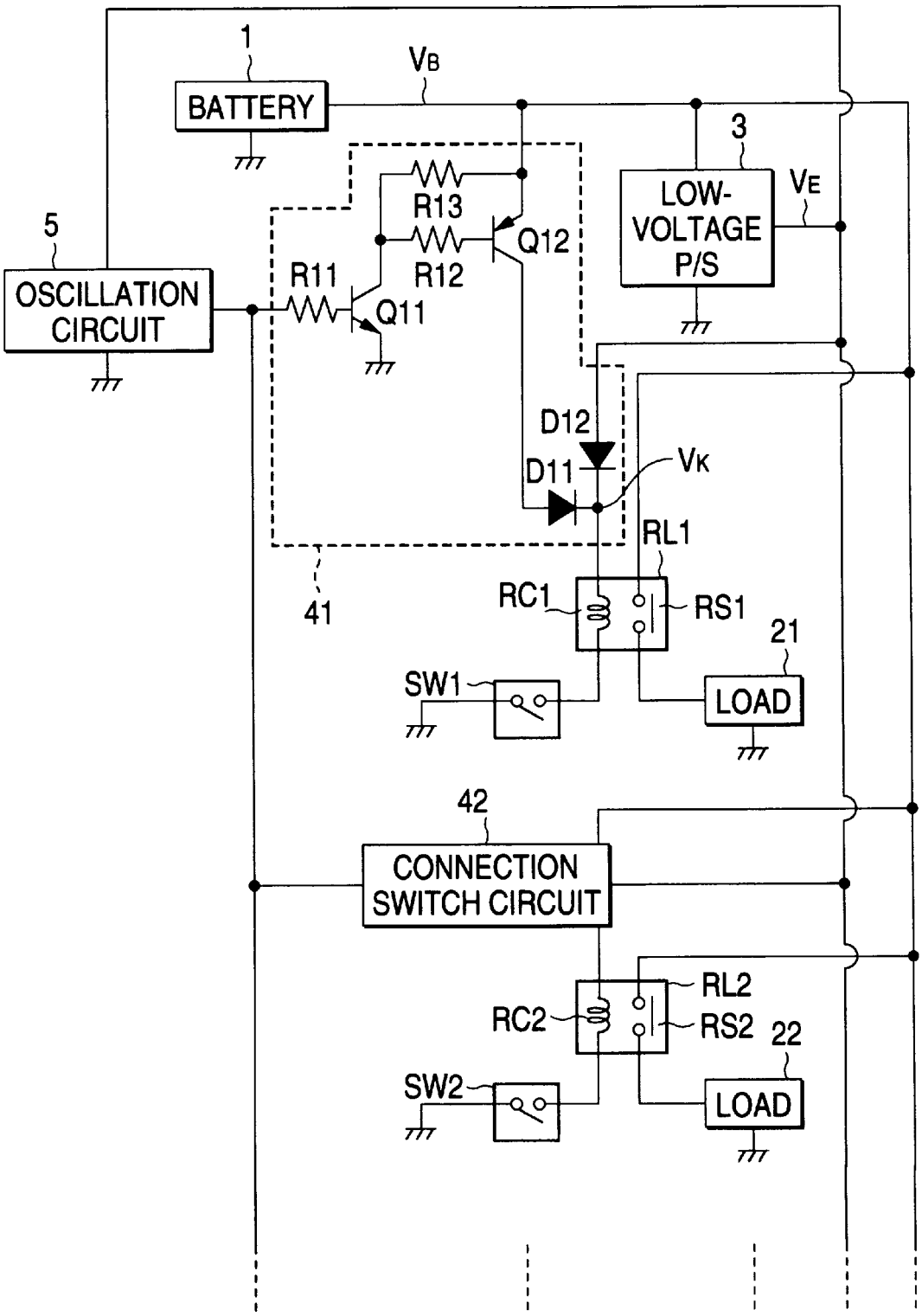
FIG. 11 is a circuit diagram to show a sixth of a vehicle load control circuit to which the invention is applied.

FIG. 11 is a circuit diagram to show a sixth embodiment of a vehicle load control circuit to which the invention is applied.

The vehicle load control circuit comprises an in-car battery (reference power supply) 1, loads 21, 22, . . . of lamps, door lock solenoid, etc., relays RL1, RL2, . . . , switches SW1, SW2, . . , a low-voltage power supply 3, connection switch circuits 41, 42, . . . , and an oscillation circuit 5 for controlling a power supply from the in-car battery 1 to the loads 21, 22, . . .

The relays RL1, RL2, . . . , the low-voltage power supply 3, and the connection switch circuits 41, 42, . . . are placed in an electric junction box disposed in a proper place in the vehicle. The connection switch circuits 41, 42, . . . have a similar configuration.

The relay RL1 is made up of relay contacts RS1 placed between the in-car battery 1 and the load 21 and a coil RC1 placed between the connection switch circuit 41 and the switch SW1.

Relay actuating voltage $V_S$, namely, coil application voltage at which the relay contacts are actuated is about 7–8 VDC. Relay release voltage $V_R$, namely, coil application voltage at which the relay contacts are released is about 2–3 VDC. Output voltage of the in-car battery 1, $V_B$, is a value higher than the actuating voltage $V_S$ (in the embodiment, 12 VDC).

The switches SW1, SW2, . . . are switches such as operation switches operated by the vehicle user and semiconductor switching elements turned on/off in response to the detection result of a sensor (not shown); one of switch contacts is connected to one end of the coil RC1 of the relay RL1 and the other is grounded.

The low-voltage power supply 3 is made of a switching power supply circuit made of a DC-DC converter using a switching transistor (not shown). It switches the output voltage $V_B$ of the in-car battery 1 applied to a primary winding by the switching transistor, rectifies and smooths a voltage induced on a secondary winding, and outputs voltage $V_E$. The output voltage $V_E$ is $(V_B>)V_S>V_E>V_R$ and is set to a value close to the release voltage $V_R$ (in the embodiment, 5 V).

Figure 12:
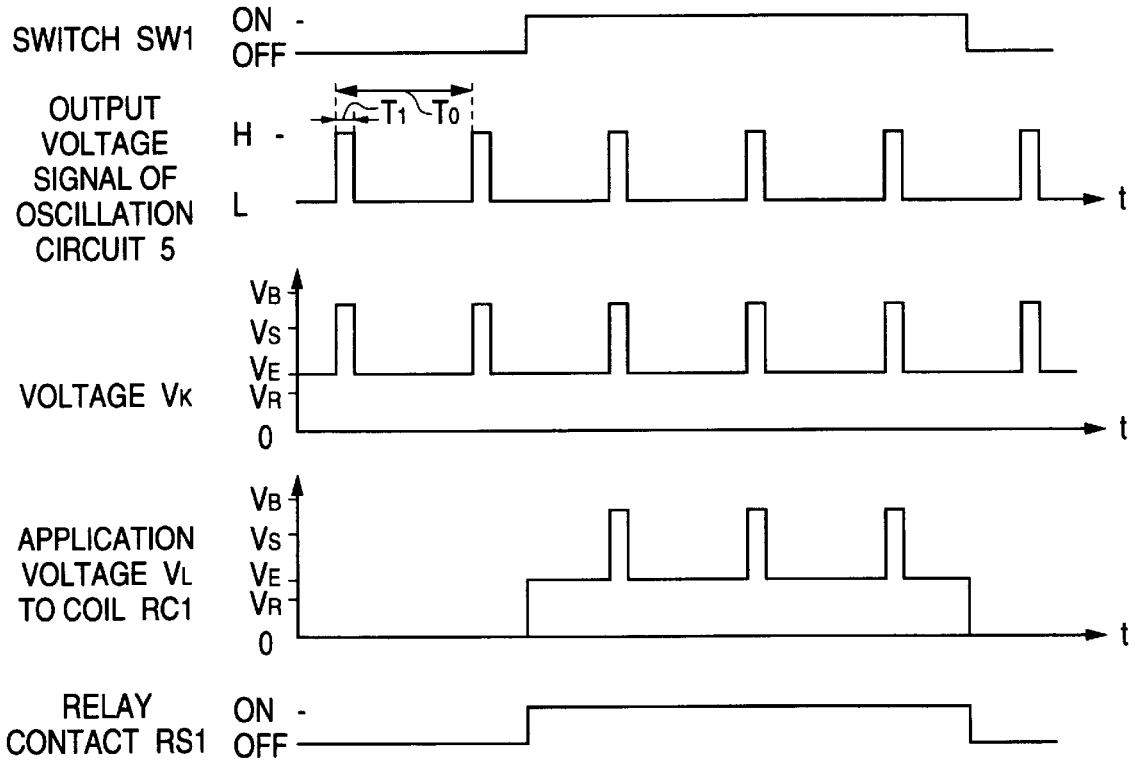
FIG. 12 is a timing chart to show the state of each part in the sixth embodiment of the invention.
Figure 13:
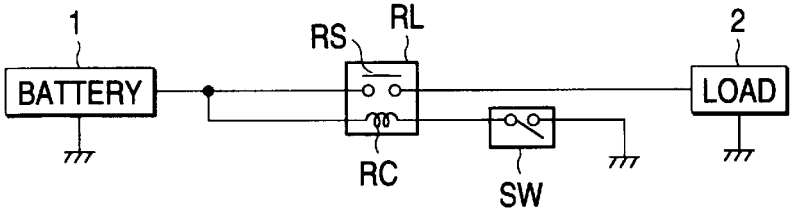
FIG. 13 is a circuit diagram to show a conventional relay drive circuit.
Figure 14:
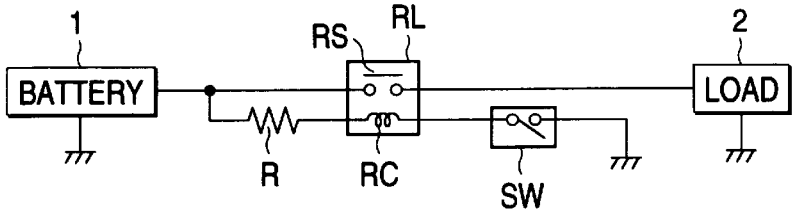
FIG. 14 is a circuit diagram to show a conventional relay drive circuit.
Figure 12:
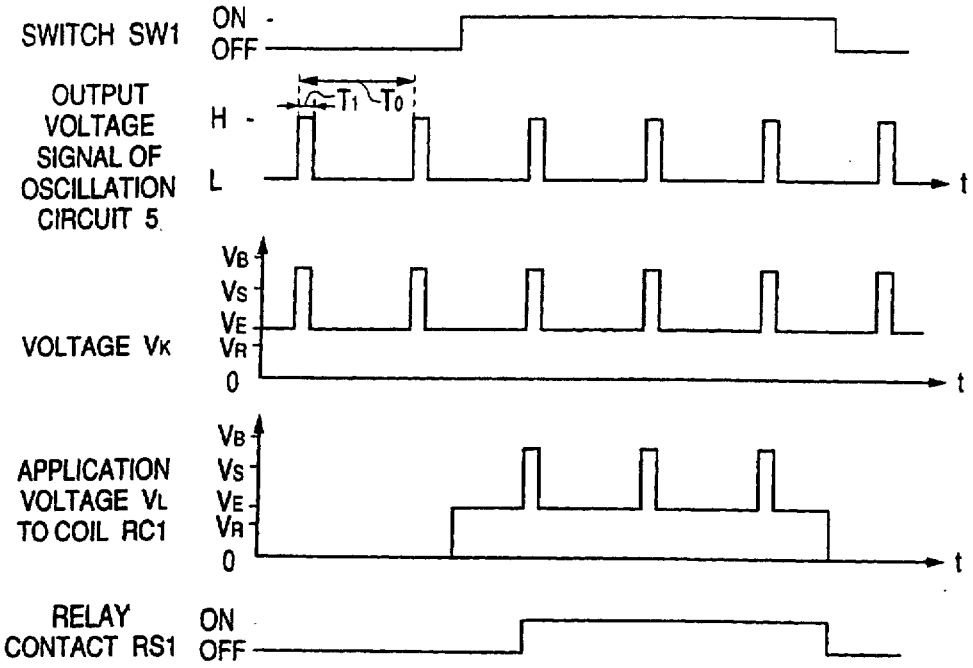
Figure 13:
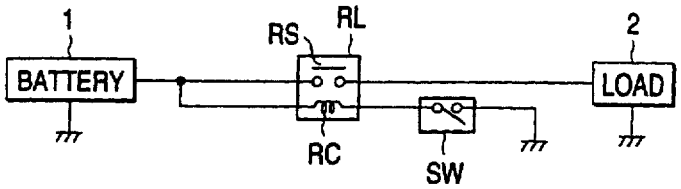
Figure 14:
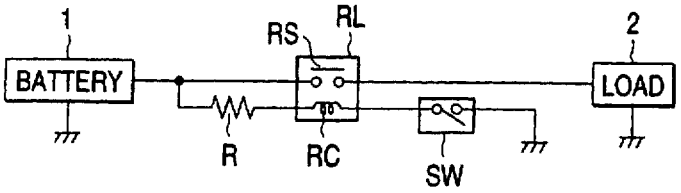

The oscillation circuit 5 outputs a pulse signal of a predetermined pulse width on a given period from an oscillation output terminal, as shown in FIG. 12 (described later). The connection switch circuit 41 comprises transistors Q11 and Q12, diodes D11 and D12, and resistors R11–R13.

The oscillation output terminal of the oscillation circuit 5 is connected to a base of the transistor Q11 via the resistor R11. An emitter of the transistor Q11 is grounded and a collector is connected to a base and an emitter of the transistor Q12 via the resistors R12 and R13 respectively.

The emitter of the transistor Q12 is connected to a voltage output terminal of the in-car battery 1 and a collector of the transistor Q12 is connected to an anode of the diode D11. A cathode of the diode D11 is connected to a cathode of the diode D12 and one end of the coil RC1. An anode of the diode D12 is connected to a voltage output terminal of the low-voltage power supply 3.

Next, the operation of the vehicle load control circuit will be discussed with FIG. 12, which is a timing chart to show the state of each part in the embodiment.

A pulse voltage signal of a predetermined pulse width $T_1$ is output on a given period $T_0$ from the oscillation output terminal of the oscillation circuit 5. When the pulse voltage signal is high, the transistor Q11 is turned on, thereby turning on the transistor Q12, and cathode voltage $V_K$ of the diode D11 becomes equal to the output voltage $V_B$ of the in-car battery 1 higher than the relay actuating voltage $V_S$. At this time, the diode D12 blocks current flowing into the anode.

On the other hand, when the pulse voltage signal from the oscillation circuit 5 is low, the transistors Q11 and Q12 are turned off. Thus, the cathode voltage $V_K$ becomes equal to the output voltage $V_E$ of the low-voltage power supply 3 lower than the relay actuating voltage $V_S$. At this time, the diode D11 blocks current flowing into the anode.

Thus, the cathode voltage $V_K$ becomes a voltage periodically matching the output voltage $V_B$ of the in-car battery 1 and the output voltage $V_E$ of the low-voltage power supply 3 in synchronization with the pulse voltage signal of the oscillation circuit 5, as shown in FIG. 12.

Therefore, if the switch SW1 is turned on while the pulse voltage signal from the oscillation circuit 5 is low, an excitation current is supplied to the coil RC1 and application voltage $V_L$ to the coil RC1 of the relay RL1 becomes equal to the output voltage $V_E$ of the low-voltage power supply 3. At this time, the application voltage $V_L$ is lower than the relay actuating voltage $V_S$, thus the relay contacts RS1 are not turned on.

Next, when the pulse voltage signal from the oscillation circuit 5 goes high, the application voltage $V_L$ to the coil RC1 becomes equal to the output voltage $V_B$ of the in-car battery 1 higher than the relay actuating voltage $V_S$, whereby the relay contacts RS1 are turned on.

After this, if the pulse voltage signal from the oscillation circuit 5 goes low, the application voltage $V_L$ to the coil RC1 becomes equal to the output voltage $V_E$ of the low-voltage power supply 3 slightly higher than the release voltage $V_R$, thus the relay contacts RS1 are held on.

When the switch SW1 is turned off, the excitation current supply to the coil RC1 is stopped and the relay contacts RS1 are turned off.

Thus, according to the sixth embodiment, the vehicle load control circuit comprises the low-voltage power supply 3 outputting the voltage $V_E$ lower than the output voltage $V_B$ of the in-car battery 1 and slightly higher than the relay release voltage $V_R$ in addition to the in-car battery 1 and applies the output voltage $V_B$ of the in-car battery 1 to the relay coil periodically when the switch SW1 is on and the output voltage $V_E$ of the low-voltage power supply 3 while the switch SW1 is not on, so that it can reliably turn on the relay contacts when the output voltage $V_B$ of the in-car battery 1 is applied first after the switch SW1 is turned on. Then, the output voltage $V_B$ is applied periodically and otherwise, the output voltage $V_E$ of the low-voltage power supply 3 is applied, whereby the heating value from the coils can be reduced as compared with continuation of application of the output voltage $V_B$ of the in-car battery 1.

The switching power supply circuit having a small heating value is used as the low-voltage power supply 3, whereby the heat generation of the whole circuit can be decreased.

The single low-voltage power supply 3 is used to drive a plurality of relays, whereby the heating value can be most decreased.

If the relay contacts RS1 are released for a reason such as vibration or impulse while the relay contacts RS1 are actuated and the output voltage $V_E$ of the low-voltage power supply 3 is applied, the output voltage $V_B$ of the in-car battery 1 is applied on the period $T_0$, so that the relay contacts RS1 can be restored to the actuation state reliably within the period $T_0$.

The pulse width $T_1$, of the pulse voltage signal output from the oscillation circuit 5 may be set to a value at which the relay contacts RS1 are reliably actuated. To rapidly restore the relay contacts to the actuation state if the relay contacts are released regardless of the actuation state, the period $T_0$ may be set to a short value; to furthermore reduce the heating value from the coils, the period $T_0$ may be set to a long value. For example, $T_1$ can be set to 10 msec and $T_0$ can be set to 100 msec.

The low-voltage power supply 3 may be disposed in a plurality of electric junction boxes in the vehicle for connection to a plurality of relays. It may also be disposed in one place in the vehicle for connection to all relays. In this case, the single low-voltage power supply 3 is used to drive all relays, whereby the heating value can be most decreased.

The low-voltage power supply 3 may be shared as a power supply of 5-V circuit parts of an electronic controller, etc., whereby an increase in the number of parts can be suppressed and the heating value can be decreased.

The low-voltage power supply 3 may be made of a primary or secondary battery of the output voltage $V_E$. To use a secondary battery, the low-voltage power supply may be able to be charged by the in-car battery 1.

We have discussed the embodiments of applying the invention to the vehicle load control circuits, but the invention is not limited to them and may be applied to general relay drive circuits.

As we have discussed, according to the invention, when a relay actuation instruction is given, the excitation current is periodically supplied as long as the preset time to each relay coil from the reference power supply outputting the given voltage higher than the relay actuating voltage and the excitation current is supplied to each relay coil from the low-voltage power supply outputting a voltage higher than the relay release voltage. Thus, when the excitation current is supplied from the reference power supply, the relay contacts can be actuated and while the excitation current is supplied from the low-voltage power supply, the relay contacts can be held in the actuation state. Resultantly, the heating value from the coils can be reduced as compared with continuous supply of the excitation current from the reference power supply. If the actuated relay contacts are released for a reason such as vibration or impulse, when another excitation current is supplied from the reference power supply, the relay contacts can be restored to the actuation state.

When a pulse signal of a pulse width equal to the setup time is output on a given period and a relay actuation instruction is given, the excitation current is supplied from the reference power supply only while the pulse signal is output, whereby the excitation current can be reliably supplied from the reference power supply to the coil as long as the setup time every given period.

The excitation current is supplied from the low-voltage power supply outputting a voltage lower than the relay actuating voltage, whereby the heating value from the coils can be furthermore reduced.

What is claimed is:

1. A relay drive circuit for controlling an excitation current supplied to relay coils with relay contacts placed between a reference power supply outputting a given voltage higher than a relay actuating voltage and a plurality of loads, thereby actuating or releasing the relay contacts, said relay drive circuit comprising:

a low-voltage power supply outputting a voltage lower than the given voltage and higher than a relay release voltage;

time count means for counting elapsed time since the actuation time of each relay;

storage means for storing a preset time; and control means for supplying the excitation current from the reference power supply when each relay is actuated and supplying the excitation current from the reference power supply until expiration of the preset time since the actuation time of each relay, then supplying the excitation current from said low-voltage power supply.

2. The relay drive circuit as claimed in claim 1, wherein said low-voltage power supply outputs a voltage lower than the relay actuating voltage.

* * * * *

UNITED STATES PATENT AND TRADEMARK OFFICE

CERTIFICATE OF CORRECTION

PATENT NO. : 6,236,552 B1
DATED : May 22, 2001
INVENTOR(S) : Yasuhiro Hattori

It is certified that error appears in the above-identified patent and that said Letters Patent is hereby corrected as shown below:

Drawings,
Replace Figure 12 with attached formal drawing.

Signed and Sealed this

Twenty-third Day of April, 2002

*Attest:*

*Attesting Officer*

JAMES E. ROGAN
*Director of the United States Patent and Trademark Office*